United States Patent [19]

Kline

[11] 4,232,587

[45] Nov. 11, 1980

[54] FLUID PUMP

[75] Inventor: William L. Kline, Galena, Ohio

[73] Assignee: Kline Manufacturing Co., Galena, Ohio

[21] Appl. No.: 33,191

[22] Filed: Apr. 25, 1979

[51] Int. Cl.[3] ..... F01B 13/04

[52] U.S. Cl. ..... 91/499

[58] Field of Search ..... 91/499–507, 91/487

[56] References Cited

U.S. PATENT DOCUMENTS

| | | | |
|---|---|---|---|
| 2,642,810 | 6/1953 | Robinson | 91/499 |
| 2,925,046 | 2/1960 | Budzich | 91/507 |
| 3,046,906 | 7/1962 | Budzich | 91/487 |
| 3,126,835 | 3/1964 | Kline | 91/487 |
| 3,160,109 | 12/1964 | Kline | 91/487 |
| 3,285,193 | 11/1966 | Jeannin | 91/507 |
| 3,861,276 | 1/1975 | Lucien et al. | 91/499 |

*Primary Examiner*—William L. Freeh

*Attorney, Agent, or Firm*—Oliver E. Todd, Jr.

[57] ABSTRACT

A hydraulic pump or motor device comprises a rotatable barrel containing a plurality of coaxially aligned pistons operably connected to an adjustably inclinable swash plate. The barrel is connected to a drive shaft through a concentrically disposed torque tube having two pairs of splined couplings which each incorporate a spherically profiled male spline element. In operation, the swash plate, barrel and drive shaft are subjected to unbalanced reaction forces concentrated in the semicircle of barrel rotation corresponding to the pumping strokes of the pistons. These unbalanced forces cause bowing or radial deflection of the drive shaft which is compensated by the motion freedom of the spherically splined couplings.

5 Claims, 5 Drawing Figures

FIG. 1
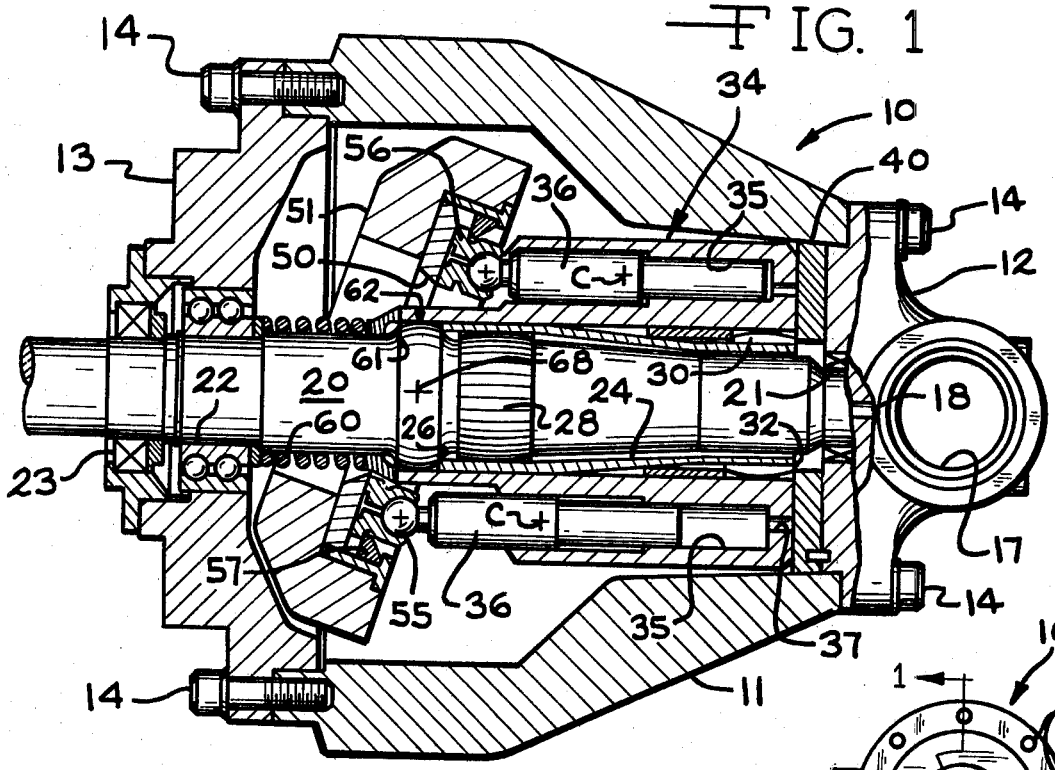
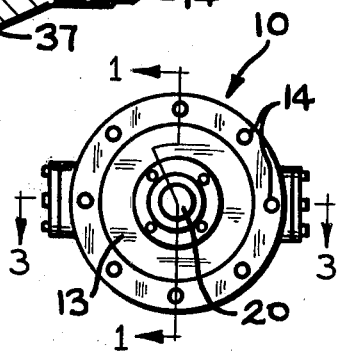
FIG. 1A
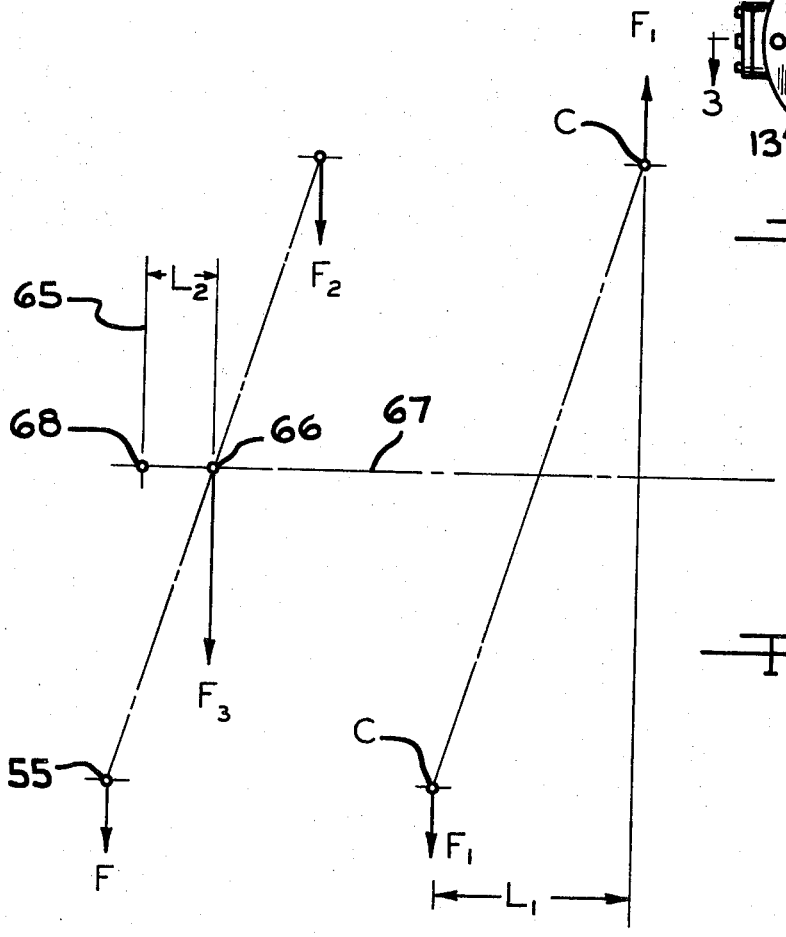
FIG. 2

FLUID PUMP

BACKGROUND OF THE INVENTION

The invention relates generally to an improvement in an axial piston pump and more specifically to a spline configuration which ensures constant alignment of the pump components which are subjected to varying unbalanced axial and radial forces at varying combinations of rotational speeds and pressure loads.

The axial piston pump has been the subject of numerous improvements and patents. Generally, such a pump comprises a cylindrical barrel in which a plurality of pistons are concentrically disposed about the barrel axis and slidably mounted in cylinders in the barrel for reciprocal motion parallel to the barrel axis. Reciprocal motion is imparted to the pistons by a swash plate which is adjustably inclinable with respect to the axis of the barrel.

A stationary valve plate positioned immediately adjacent the end of the barrel opposite the swash plate contains intake and discharge channels which are in alternating sequential registry with the cylinder volumes as they fill and pump hydraulic fluid, respectively.

An ever present problem to which axial pumps are subject involves the bowing or lateral deformation of the drive shaft caused by the uneven forces to which it is subjected. These uneven forces are reaction forces associated with the load imposed by pumping of the hydraulic fluid during that portion of barrel rotation in which the pistons are advancing into the cylinders. These uneven and unbalanced forces tend to produce bowing of the drive shaft and tilting of the barrel relative to the valve plate. The common manifestation of such skewing is leakage of hydraulic fluid between the valve plate and the barrel. The resulting leakage may be minor or it may increase at high operating pressures to the extent that the efficiency of the pump is severely impaired. This condition, at best, is undesirable and in certain applications can be hazardous.

A solution to the problem of barrel-valve plate separation and fluid leakage utilized in many prior art designs comprises a floating mounting of either the barrel or the valve plate. The alternate component is fixedly mounted and this arrangement is intended to maintain planar alignment of the faces of the valve plate and barrel. A relatively tight seal is thus intended to be maintained between them and leakage is expected to be minimized over a broad range of operating conditions.

It has been found, however, that the barrel-valve plate misalignment problem is highly complex. Not only is the barrel subject to forces which tend to angularly skew it with respect to the valve plate, but it is also affected by unbalanced forces which tend to translate the barrel radially. Furthermore, these forces have been found to vary widely with the rotational speed and the instantaneous delivered hydraulic pressure.

SUMMARY OF THE INVENTION

The invention herein described and claimed comprises an axial piston pump having splined connections incorporating generally spherical male splines interposed between the drive shaft, torque tube and barrel components of the pump.

The species of axial pump to which my invention is particularly adapted is that utilizing a torque tube such as is disclosed in my two issued U.S. Pat. Nos. 3,126,835 and 3,160,109. The torque tube is a relatively thin-walled cylindrical torque transfer device concentrically interposed between the drive shaft and barrel. The torque tube is first of all a power transfer member which drives the barrel from the drive shaft. Secondly, it acts as a radially or laterally flexible member which assists in the maintenance of planar alignment and minimum leakage between the barrel and valve plate. Lastly, it acts as a torsional shock absorber which damps the pulsations of the pistons, thereby quieting the operation and extending the service life of the pump.

According to the instant invention, one end of the torque tube contains a straight female spline which mates with a male spline on the drive shaft having a spherical profile. Such a splined interconnection serves to positively transfer rotational motion while also permitting both relative axial motion between the torque tube and shaft and pivotal motion by the torque tube about the center of the sphere defined by the male spline disposed on the shaft.

A second spline pair connects the opposite end of the torque tube with the pump barrel. This spline pair comprises a male spline having a generally spherical profile disposed on the end of the torque tube which mates with a straight female spline positioned within the barrel. The instant invention also comprehends the utilization of a single spherical male spline in one of the two splined connections. The use of two spherical splines is, however, preferred.

Such a structure between the drive shaft and barrel incorporating both the torsional shock absorbing characteristics of a torque tube drive and the axial and pivotal freedom of the spherically splined connections compensates for the radial deflection of the drive shaft and encourages the maintenance of a tight seal between the end of the barrel and the valve plate over a wide range of rotational speeds and pressure loads.

It is therefore an object of the instant invention to provide an improved internal drive train for an axial piston pump.

It is a further object of the instant invention to provide an improved structure for connecting the drive shaft and barrel of an axial piston pump.

It is a still further object of this invention to provide an axial piston pump which is not subject to the leakage between the barrel and valve plate which is common to conventional axial piston pump designs.

BRIEF DESCRIPTION OF THE DRAWINGS

FIG. 1 is a fragmentary sectional view of an axial piston pump according to the instant invention taken along line 1—1 of FIG. 1A;

FIG. 1A is a left end elevational view, on a reduced scale, of an axial piston pump of the instant invention;

FIG. 2 is a diagrammatic representation of the forces acting upon the barrel of a piston pump during operation;

DESCRIPTION OF THE PREFERRED EMBODIMENT

Figure 3:
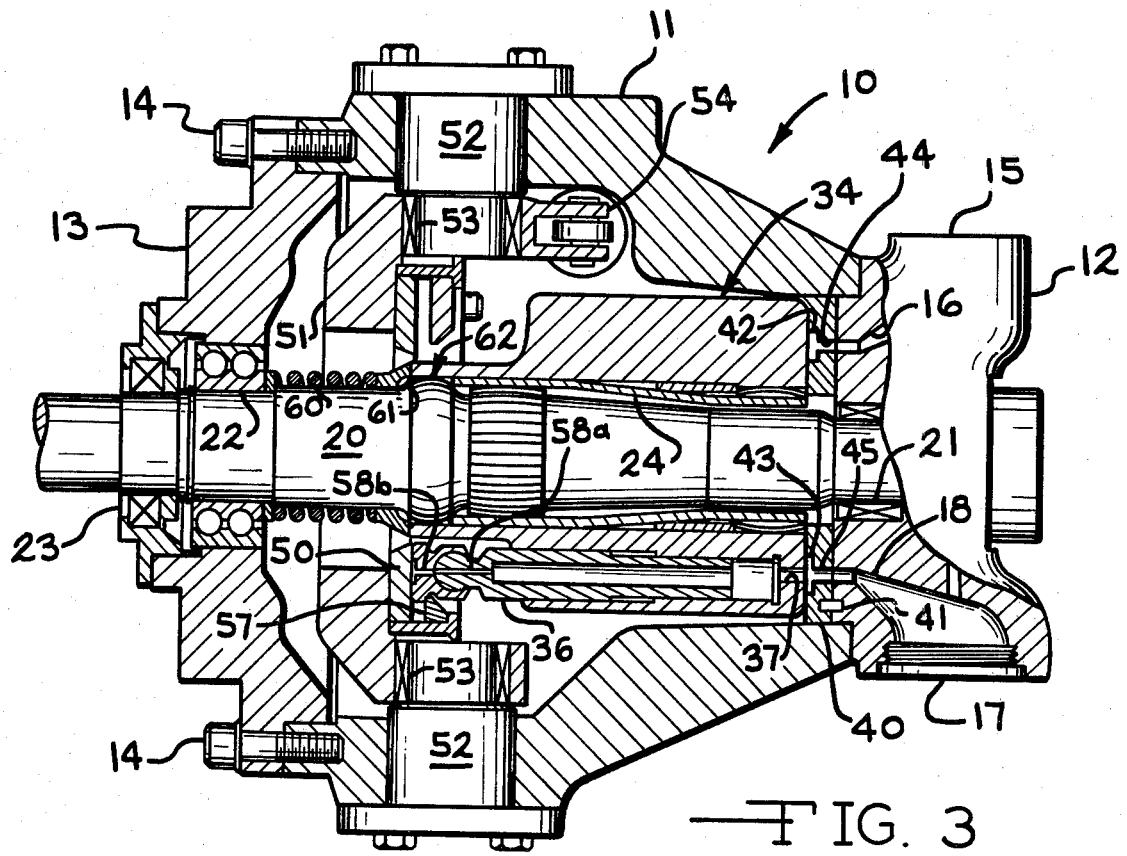
FIG. 3 is a fragmentary sectional view of an axial piston pump according to the instant invention taken along line 3—3 of FIG. 1A.

Referring now to FIG. 1, a fluid pump according to the instant invention is generally designated by the reference number 10. The fluid pump 10 includes a generally hollow cast housing 11 having a mating port cap 12 and an end bell 13 sealingly secured to the conical housing 11 by conventional threaded fasteners 14.

Reference to FIG. 3 illustrates that the port cap 12 includes a fluid intake opening 15 and passageway 16 leading into the housing 11. The port cap 12 further includes a fluid discharge opening 17 and passageway 18 leading from the housing 11. The inner walls of the openings 15 and 17 are preferably threaded to facilitate connection of the pump 10 to associated hydraulic lines and equipment. The port cap 12 may also house a gear type lubrication pump (not shown) which is utilized to supply lubricating hydraulic fluid to the various components of the pump 10 which are subject to substantial sliding and rotating friction. Details of such a lubrication pump are described in detail in my issued U.S. Pat. No. 3,160,109.

Referring again to FIG. 1, the pump 10 is also seen to comprise a drive shaft 20 which is disposed generally coaxially within the housing 11. The drive shaft 20 is supported at its terminus in the port cap 12 by an anti-friction bearing 21 such as a roller bearing and is supported within the end bell 13 by a second anti-friction bearing 22 which may be either a ball or roller bearing. An oil seal 23 disposed between the shaft 20 and the end bell 13 inhibits leakage of hydraulic fluid from within the housing 11.

Figure 4:
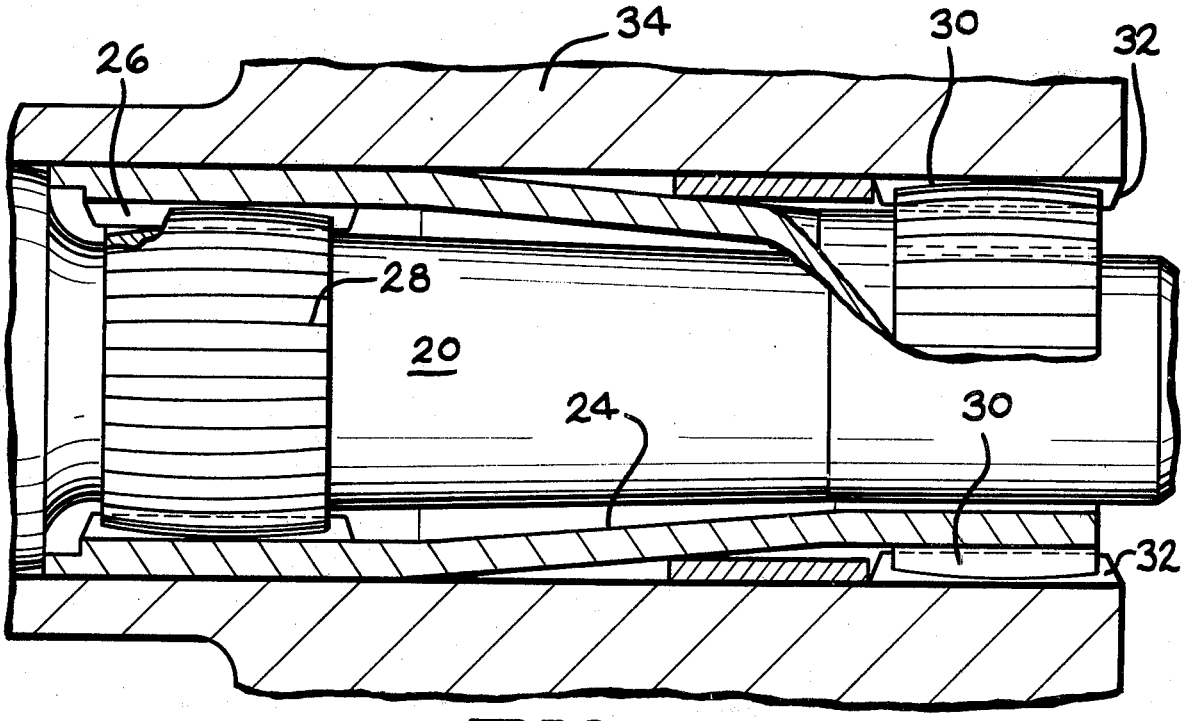
FIG. 4 is an enlarged fragmentary sectional view of the torque tube and splined connectors according to the instant invention.

Also positioned within the housing 11 and disposed concentrically about the drive shaft 20 is a thin-walled sleeve or torque tube 24. As best shown in FIG. 4, the torque tube 24 includes a straight female spline 26 at its end adjacent the end bell 13 which slidably engages a spherically profiled male spline 28 disposed on the drive shaft 20. The torque tube 24 further includes a spherically profiled male spline 30 at its end adjacent the port cap 12 which slidably engages a straight female spline 32. The female spline 32 may be a component of a pump barrel 34 which is concentrically disposed about the drive shaft 20 and the torque tube 24 and rotates therewith. The torque tube 24 thus functions to transfer rotary motion between the drive shaft 20 and the barrel 34. The torque tube 24 and the splined interconnections between it, the drive shaft 20 and the barrel 34 will be described in greater detail subsequently.

Again with reference to FIG. 1, the barrel 34 can be seen to define a plurality of uniformily spaced elongate cylinder chambers 35. The cylinder chambers 35 are disposed in a circle concentric with and each has an axis parallel to the common axis of the barrel 34, the torque tube 24 and the drive shaft 20. Generally, nine cylinders are utilized since this number allows optimum utilization of the annular volume occupied by the barrel 34. Each of the cylinders 35 slidably receives an elongated shouldered piston 36 and thus constrains the pistons 36 for reciprocation along axes parallel to the axis of the barrel 34. The barrel 34 also defines a plurality of axial passageways 37 aligned with the ends of the cylinder chambers 35 which provide communication between the interior of each cylinder 35 and the end of the barrel 34.

Referring now to FIG. 3, a valve plate 40, which is positioned between the end of the barrel 34 and the port cap 12, is illustrated. The valve plate 40 is held stationary by one or more locating pins 41 set in blind holes in the plate 40 and the end cap 12. The valve plate 40 includes two discontinuous arcuate channels 42 and 43 recessed in its face adjacent the barrel 34. Each arcuate channel 42 and 43 extends over approximately 170 radial degrees with approximately 10 degrees of land between adjacent ends and thus alternately registers with the passageways 37 during slightly less than one-half of each rotation of the barrel 34. The arcuate channels 42 and 43 are independently in communication with the inlet passageway 16 and discharge passageway 18, respectively, through axial passageways 44 and 45 in the valve plate 40. Hydraulic fluid may thus flow through the pump 10 from the inlet opening 15, through the passageways 16 and 44, the channel 42, the axial passageways 37, into the cylinder chambers 35, out through the passageways 37, the channel 43, the passageways 45 and 18 and finally out the discharge opening 17. As the barrel 34 rotates, each of the chambers 35 is alternately in communication with the intake opening 15 and the discharge opening 16 for approximately 170 degrees of barrel rotation.

Reference to FIGS. 1 and 3 illustrates the inclinable swash plate drive assembly for the pistons 36. Axially spaced from the end of the barrel 34 and opposite the valve plate 40 is an annular swash plate 50. The swash plate 50 is disposed concentrically about the drive shaft 20 and retained in an inclinable hanger 51 which is pivoted about a pair of trunnions 52. Disposed between the hanger 51 and trunnions 52 are a pair of anti-friction bearings 53 such as roller bearings. The hanger 51 further includes a control arm 54 disposed generally perpendicularly to the swash plate 50 which is connected to a control mechanism (not shown) which forms no part of this invention. The control mechanism may be either manually, electrically or pneumatically powered. In any case, it adjusts the angle of inclination of the hanger 51 and swash plate 50 relative to the barrel 34 and drive shaft 20 from perpendicular to approximately 20 degrees of inclination.

The individual pistons 36 are each operably connected to the swash plate 50 by means of a ball 55 secured thereto and contained in a socket 56 which is positioned in abutment with the swash plate 50 and retained there by a split annular keeper ring 57. The pistons 36 and balls 55 and sockets 56 both contain axially disposed lubrication channels **58*a* and 58*b* which provide a flow of lubricating hydraulic fluid to the face of the swash plate 50**.

A compression spring 60 concentrically located about the drive shaft 20 and positioned between the end bell 13 and a skirt 61 of the barrel 34 biases the barrel 34 towards the valve plate 40 and assists in the maintenance of a seal therebetween. The skirt 61 of the barrel 34 is in contact with the drive shaft 20 along an enlarged cylindrical shoulder section 62. The shoulder section 62 is crowned or convex and therefore allows the barrel 34 to pivot about it. The axial position of the crowned shoulder section 62 is significant and the parameters relevant to selecting an axial position are set out in my issued U.S. Pat. No. 3,160,109 and will be briefly described below.

Functioning as a pump, the device thus far described comprehends that rotary motion of the drive shaft 20 will be transferred through the torque tube 24 and will result in the rotation of the barrel 34 relative to the inclined swash plate 50 to effect reciprocation of the pistons 36 relative to the barrel 34. As the barrel 34 is rotated, hydraulic fluid will be drawn into the intake opening 15 and intake passage 16 in the port cap 12, the axial passage 44 in the valve plate 40 and those cylinder chambers 36 having their intake and discharge passages 37 in registry with the arcuate intake channel 42 in the valve plate 40. Further rotation of the barrel 34 will cause the passages 37 previously in registry with intake channel 42 to be moved into registry with the arcuate discharge channel 43. Movement of the piston 36 toward the valve plate 40 will cause hydraulic fluid to be delivered outwardly through the axial passage 45, the passageway 18 and the discharge opening 17. The angle of inclination of the swash plate 50 will determine the displacement of the pump 10 and thus the quantity of fluid delivered per revolution. The displacement of the pump may, of course, be varied by varying the inclination of the swash plate 50.

When the pump 10 is operated at moderate rotational speeds and delivered hydraulic pressures, it has been found that the torque tube 24 provides sufficient radial freedom to maintain sealing contact between the end of the barrel 34 and valve plate 40. However, as the rotational speed and delivered pressure increase, the magnitudes of various reaction forces rise to such levels that the torque tube alone is no longer able to compensate for them and barrel to valve plate leakage results. The two forces which tend to radially distort the drive shaft and thus produce leakage are a force couple generated by the revolving axially displaced pistons and a force moment generated by the reaction forces of the pistons against the inclined swash plate.

As can be seen from FIGS. 1 and 2, during rotation of the barrel 34 the displacement of the centers of gravity C of diametrically opposed pistons 36 will result in equal centrifugal forces being applied to the barrel 34 at varying points along the longitudinal axis of the barrel 34. The centrifugal force F1 on each piston 36 acts through the center of gravity C of the piston 36 in a direction radially outwardly from the axes of the barrel 34 and drive shaft 20. When the swash plate 50 is inclined, as is shown in FIG. 1, the centers of gravity C of the pistons 36 are displaced an axial, longitudinal distance L1, as is shown in FIG. 2, which is equal to the stroke of the pistons 36. The centrifugal forces F1 of diametrically opposed longitudinally displaced pistons 36 will thus apply a dynamic couple F1L1 to the barrel 34 which is a product of the centrifugal force acting on one of the pistons 36 multiplied by the axial, longitudinal displacement of the centers of gravity C of the opposed pistons 36. The instantaneous value of this couple on the barrel 34 will vary from zero when the centers of gravity of the pistons 36 are aligned at right angles to the drive shaft 20 as is generally illustrated in FIG. 3, to a maximum value when the centers of gravity of diametrically opposed pistons are in their maximum displaced position as is generally illustrated in FIGS. 1 and 2, and the barrel 34 is rotating at a maximum speed. From FIG. 2 it can be seen that the torque caused by the couple F1L1 tends to tilt the barrel 34 in a counterclockwise direction.

Since the couple F1L1 is dynamic, that is, it varies with lateral displacement of the pistons 36 and the rotational speed of the barrel 34, it is difficult to fully compensate or counter-balance the couple F1L1 under all operating conditions. However, it has been found possible to partially counteract this dynamic couple by incorporating certain structural configurations into the fluid pump. One such configuration involves a lateral offset of bearing points about the swash plate 50 and barrel skirt 61.

A force moment which is generated by reaction forces associated with the pumping of hydraulic fluid is also illustrated in FIGS. 1 and 2. The pressurized hydraulic fluid in the chambers 35 exerts an axial thrust on the pistons 36, which is transferred to the inclined swash plate 50 through the ball 55 and socket 56 joints. Thus, at the centers of each of the balls 55 there will be a radial component of this axial thrust, namely, force F2 tending to move the ends of the pistons 36 downward as viewed in FIG. 1. The two forces F2 may be resolved into a single resultant force F3 acting on the barrel 34 in the same direction as the two forces F2 and extending from the point of intersection of the axis of the drive shaft 20 and the plane describing the locus of the centers of the piston ball joints 55. The lateral center line of the shoulder section 62 of the drive shaft 20 is designated by the number 65. The center line 65 is displaced to the left a distance L2 of a point 66 which represents the intersection of the axis 67 of the drive shaft 20 and the plane defined by the locus of the centers of the ball joints 55 on the pistons 36. Accordingly, the resultant force F3 acting at the point 66 is directed radially outwardly from the axis 67 of the drive shaft 20 and at right angles to the axis of the barrel 34. It will therefore exert a moment F3L2 on the barrel 34 about the point 68 of the shoulder section 62, where L2 is the distance along the axis 67 of the drive shaft 20 from the point 67 to the center line 65 of the shoulder section 62. This moment, F3L2, is also dynamic since F3 is a reaction force which will vary with the delivered pressure of the pumped fluid. This dynamic moment, F3L2, will tend to tilt the barrel about the point 68 in a clockwise direction. The dynamic moment F3L2 is thus in opposition to the dynamic couple F1L1.

The magnitude of the moment F3L2 at any instant is also determined by the distance L2 and thus the location of the shoulder section 62. The distance L2 between the center line 65 of the shoulder section 62 and the point 66 which represents the intersection of axis 67 of the drive shaft 24 and the plane defined by the locus of the centers of the ball joints 55 on the pistons 36 is selected so that for a given speed of rotation of the barrel 34, average delivered fluid pressure and inclination of the swash plate 50, the moment F3L2 will equal the dynamic couple F1L1 and thus substantially eliminate any tendency of the barrel 34 to tilt relative to the axis 67 of the drive shaft 20. Therefore, within a reasonable range of pump operation, the location of the shoulder section 62 and its lateral center line 65, to the left of the point 66, will minimize the tendency of the barrel to tilt, even though the opposing torques F1L1 and F3L2 are not exactly equal.

While this configuration has been found to improve the performance and service life of such axial hydraulic piston pumps, it is clear that the above solution is but a dynamic compromise which will counterbalance the torques which tend to tilt the barrel 34 only at certain combinations of rotational speed, pressures and swash plate inclinations.

With reference to FIG. 4, a further improvement, which forms the instant invention, is illustrated. As previously noted, the torque tube 24 is disposed intermediate the drive shaft 20 and barrel 34 and transfers rotational energy therebetween by the utilization of spline sets 26 and 28 and 30 and 32. Since it is clear from the foregoing that the dynamic operating conditions of the pump 10 are such that compensation or counterbalancing of reaction forces and barrel torques over the full range and combination of operating conditions poses several problems, the instant invention proposes the use of curved or spherically profiled male splines 28 and 30 as part of the rotational energy transfer train between the drive shaft 20 and barrel 34. Since the purpose of the spherical splines 28 and 30 is to compensate for or permit skewing and lateral misalignment of the barrel 34 relative to the drive shaft 20, the radius of curvature of the males splines 28 and 30 is not critical. A radius of curvature, therefore, which results in a spline having a maximum to minimum diameter difference from its lateral center line to either end of less than 0.010 inches is proposed.

With reference to FIGS. 2 and 4, the freedom which the spherically profiled spline couplings 26 and 28 and 30 and 32 allow the barrel 34 to move will be described. Two general operating conditions should be considered: the first when the centrifugal dynamic couple F1L1 exceeds the value of the dynamic moment F3L2 and the second when the opposite direction exists.

During certain operating conditions of the pump 10, the various parameters of fluid pressure, rotational speed and swash plate inclination will generate a couple F1L1 greater than moment F3L2. The barrel 34 will therefore tend to rotate counterclockwise about an axis passing through the axis 67 and perpendicular to the plane described by the axis 67 and the lines of force of F1. Lacking the spherical spline connections 26 and 28 and 30 and 32, the barrel would tend to tilt and lift from the valve plate 40. Leakage of hydraulic fluid between the face of the barrel 34 and valve plate 40 would thus result. However, the inclination of the splined connection reduces the tendency of the barrel 34 to pivot about the point 66. Rather, the barrel 34 tends to be displaced laterally from the axis 67 of the drive shaft 24 while maintaining snug contact with the valve plate 40.

Conversely, the operating parameters of the pump may be such that the moment F3L2 exceeds the dynamic couple F1L1 and the barrel 34 is acted upon by a torque tending to rotate it clockwise about an axis passing through the axis 67 and perpendicular to the plane described by the axis 67 of the drive shaft 24 in the lines of the forces F2. Again, the spherical spline connections 26 and 28 and 30 and 32 permit the barrel 34 to translate laterally rather than skew or tilt about this axis and maintain its planar relationship with the valve plate 40. It is therefore clear that the spherically splined couplings eliminate the pivots which two conventional, straight splines would represent when subjected to a radial force applied at an axially displaced location and allow the barrel 34 to translate laterally rather than tilt or skew about such fixed pivots of a conventional spline.

Since the goal of the invention is to encourage intimate valve plate to barrel face contact by eliminating the transfer of drive shaft deflection to the barrel, it should be apparent that a single spherical male spline 30 between the torque tube 24 and the barrel 34 will also accomplish this goal. Such a single spherical male spline will act as a pivot such that the opposite end of the torque tube may follow or accomodate the lateral deflection of the drive shaft while permitting the barrel face to remain in intimate contact with the valve plate. Two spherical male splines are, however, preferred.

Because of the rapidly changing lateral forces and dynamic couples present in such an axial piston hydraulic pump, it is difficult to either compensate for or counterbalance all such forces over the full range of pump operating conditions. The spherically splined connections described and claimed herein have been found to improve the maximum delivered hydraulic pressure of such pumps by minimizing leakage between the barrel 34 and valve plate 40 due to misalignment and subsequent lift off of the barrel 34. This design has also been found to extend the service life of such pumps by minimizing internal stresses of such components during the operation of such pumps.

It will be apparent to those skilled in the art that various modifications may be made to the preferred embodiment described above without departing from the spirit and scope of the following claims.

What I claim is:

1. In a hydraulic fluid pressure transducing device comprising a housing having two ends a port cap seated on one end of said housing and having inlet and discharge ports, an end bell seated on the end of said housing opposite said port cap, a drive shaft disposed within said housing and extending therefrom, bearing means for said shaft disposed in said port cap, a second bearing means for said shaft disposed in said end bell, a rotatable barrel disposed generally concentrically about said shaft and defining a plurality of parallel uniformly spaced cylinders in communication with both ends of said barrel, a plurality of pistons with one positioned in each of said cylinders, a swash plate disposed adjacent one end of said barrel and inclined about an axis skewed to the barrel axis, ball and socket means disposed intermediate said pistons and said swash plate for reciprocating said pistons, a valve plate adjacent the end of said barrel opposite said swash plate having arcuate inlet and outlet fluid passages in independent communication with said inlet and outlet ports, and drive means disposed between said shaft and said barrel for transferring rotary motion therebetween, the improvement comprising a splined interconnection between said shaft and said drive means and a second splined interconnection between said drive means and said barrel, at least one of said splined interconnections having generally a spherically profiled male spline.

2. The hydraulic fluid pressure transducing device of claim 1, wherein said drive means comprises a thin-walled cylinder concentrically disposed about said drive shaft.

3. In a hydraulic fluid pressure transducing device comprising a housing having two ends, a port cap seated on one end of said housing and having inlet and discharge ports, an end bell seated on the end of said housing opposite said port cap, a drive shaft disposed within said housing and extending therefrom, bearing means for said shaft disposed in said port cap, a second bearing means for said shaft disposed in said end bell, a rotatable barrel disposed generally concentrically about said shaft and defining a plurality of parallel concentrically disposed cylinders in communication with both ends of said barrel, a plurality of pistons with one positioned in each of said cylinders, a swash plate disposed adjacent one end of said barrel and inclined about an axis at right angles to the barrel axis, ball and socket means disposed intermediate said pistons and said swash plate for reciprocating said pistons, a valve plate adjacent the end of said barrel opposite said swash plate having arcuate inlet and outlet fluid passages in independent communication with said inlet and outlet ports, and drive means disposed between said shaft and said barrel for transferring rotary motion therebetween, the improvement comprising spherically profiled male spline and straight female spline connections drivingly connecting said shaft with said drive means and said drive means with said barrel.

4. The fluid pressure transducing device of claim 3 further including adjustable mounting means for inclinably positioning said swash plate about said axis at right angles to said barrel axis.

5. In a hydraulic fluid pressure transducing device comprising a housing having two ends, a port cap seated on one end of said housing and having inlet and discharge ports, an end bell seated on the end of said housing opposite said port cap, a drive shaft disposed within said housing and extending therefrom, bearing means for said shaft disposed in said port cap, a second bearing means for said shaft disposed in said end bell, a rotatable barrel disposed generally concentrically about said shaft and defining a plurality of parallel concentrically disposed cylinders in communication with both ends of said barrel, a plurality of pistons with one positioned in each of said cylinders, an inclinable swash plate disposed adjacent one end of said barrel and pivotally secured to said housing for inclination about an axis at right angles to the barrel axis, ball and socket means disposed intermediate said pistons and said swash plate for reciprocating said pistons, a valve plate adjacent the end of said barrel opposite said swash plate having arcuate inlet and outlet fluid passages in independent communication with said inlet and outlet ports, and a hollow drive tube disposed between said shaft and said barrel, one end of said drive tube having a straight female spline engaging a generally spherical male spline disposed on said drive shaft, the other end of said drive tube having a generally spherical male spline engaging a straight female spline disposed on said barrel.

* * * * *

UNITED STATES PATENT OFFICE

CERTIFICATE OF CORRECTION

PATENT NO. : 4,232,587

DATED : November 11, 1980

INVENTOR(S) : William L. Kline

It is certified that error appears in the above-identified patent and that said Letters Patent are hereby corrected as shown below:

Column 9, line 7, "In a" should be --A--.

Signed and Sealed this

*Tenth* Day of *February 1981*

[SEAL]

*Attest:*

RENE D. TEGTMEYER

*Attesting Officer*

*Acting Commissioner of Patents and Trademarks*